United States Patent [19]

Eatwell

[11] Patent Number: 4,577,685

[45] Date of Patent: Mar. 25, 1986

[54] NIPPLE PROTECTOR SLEEVE FOR USE IN A WELL CONDUIT

[75] Inventor: William D. Eatwell, Houston, Tex.

[73] Assignee: Camco, Incorporated, Houston, Tex.

[21] Appl. No.: 645,982

[22] Filed: Aug. 31, 1984

[51] Int. Cl.[4] ..... E21B 23/00

[52] U.S. Cl. ..... 166/115; 166/237; 285/86

[58] Field of Search ..... 166/115, 242, 237, 125; 285/3, 4, 84, 86, 360, 361, 396

[56] References Cited

U.S. PATENT DOCUMENTS

| | | | |
|---|---|---|---|
| 2,893,694 | 7/1959 | Waggener | 285/86 X |
| 3,082,831 | 3/1963 | Le Bus, Sr. | 166/237 |
| 3,098,667 | 7/1963 | Greenwood | 166/237 |
| 3,174,548 | 3/1965 | Webb | 166/237 |

*Primary Examiner*—James A. Leppink
*Assistant Examiner*—Thuy M. Bui
*Attorney, Agent, or Firm*—Fulbright & Jaworski

[57] ABSTRACT

A temporary and retrievable protector sleeve for protecting a well landing nipple during working of the well. A landing nipple having a tubular body with a plurality of arcuate no go lugs circumferentially positioned. A body has a support for engaging the no go lugs on the interior of the nipple for supporting the body from the nipple. A releasable latch on the body releasably latches the body to the no go lugs. A spring engages the latch and yieldably urges the latch into a locking position. A sleeve section telescopically engages the body and the latch and retracts the latch and releases the body from the no go lugs when the section is moved relative to the body.

2 Claims, 7 Drawing Figures

NIPPLE PROTECTOR SLEEVE FOR USE IN A WELL CONDUIT

BACKGROUND OF THE INVENTION

Landing nipples are used in well conduits to receive and support various types of well tools in the conduit. The landing nipples generally have a no go shoulder, and may have a polished bore for receiving a seal on the well tool and other types of profiles such as threads. However, the passage of equipment through the well conduit can damage the landing nipple.

The present invention is directed to providing a temporary and removable protector for a landing nipple's interior which can protect the interior surface of the landing nipple but which can be removed to allow the use of the landing nipple when desired. The present nipple protector sleeve is particularly useful for a special landing nipple that has a no go that is divided into a plurality of circumferentially positioned arcuate segments. The divided no go segments allow a protector sleeve mechanism to land, slide through, rotate and lock onto the no go segments and be secured thereto. This allows the protector sleeve to become mechanically restrained against both vertical and rotational forces. Another feature of the protector sleeve is to provide a structure that is thin-walled to allow a maximum clearance through the protector sleeve to perform other well work.

SUMMARY

The present invention is directed to a nipple protector sleeve for protecting the inside of a landing nipple used in a well conduit and includes a body having supporting means for engaging no go lugs on the interior of a landing nipple for supporting the body from the landing nipple. Releasable latching means are provided on the body for releasably latching the body to the no go lugs for preventing longitudinal and rotative movement of the body relative to the nipple. A sleeve section is telescopically engagable with the body and engages the latching means for releasing the latching means thereby releasing the body from the nipple when the section is moved relative to the body.

Still a further object of the present invention is wherein the sleeve includes seal means adjacent each end and on the exterior of the sleeve for engaging the interior of the nipple and protecting the nipple that is positioned between the seals. In addition, one or more grease ports may be provided through the body between the seals for injecting grease between the seals and between the interior of the landing nipple and the exterior of the body for further protecting the landing nipple.

Still a further object of the present invention is wherein the latching means is spring-biased towards the latching position.

Yet a still further object of the present invention is wherein the supporting means includes an annular ridge about the exterior of the body, a slot extending upwardly through the ridge whereby a no go lug may enter the bottom of the slot. A recess is positioned offset from and in communication with the slot between the top and bottom of the ridge for receiving a no go lug, and the top of the slot receives a portion of the latching means for movement in the top of the slot for locking and releasing a no go lug in the recess.

Still a further object of the present invention is the provision of a no go nipple for use in a well conduit which includes a tubular body having connecting means at each end for connection in a well conduit and a plurality of arcuate segments are circumferentially positioned about the interior of the nipple in which each segment has an upwardly facing shoulder.

Still a further object of the present invention is the provision of a protector sleeve for a landing nipple in a well conduit including a body having supporting means for engaging a no go lug on the interior of the nipple for supporting a body from the nipple. The supporting means includes an annular ridge about the exterior of the body, a slot extending upwardly through the ridge whereby a no go lug may enter the bottom of the slot, a recess offset from and in communication with the slot between the top and bottom of the ridge for receiving a no go lug. Releasable latching means on the body releasably latches the body to the no go lugs and the latching means includes means longitudinally movable in the top of the slots for locking and releasing a no go lug in the recess. Spring means engages the latching means and yieldably urges the latching means into the slot in a locking position. A sleeve section telescopically engages the body and engages the latch means for retracting the latching means and releasing the body from a no go lug when the section is moved relative to the body.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1A:
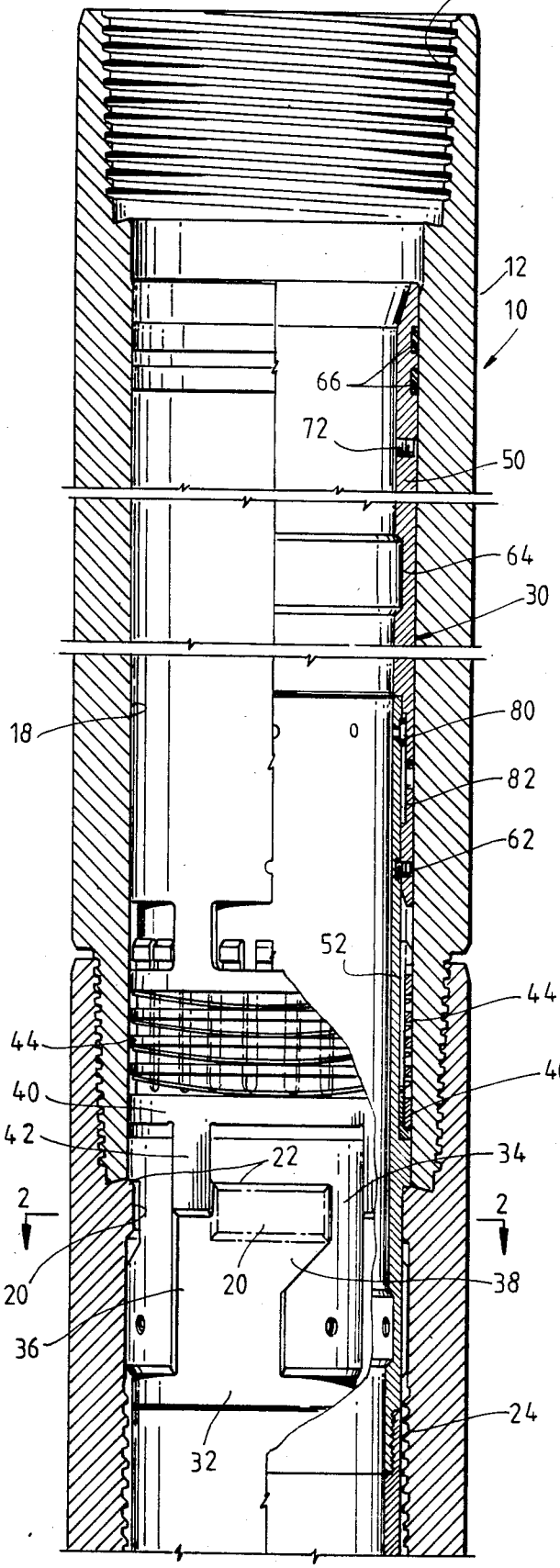
FIGS. 1A and 1B are continuations of each other and are elevational views, in cross section, illustrating the protector sleeve, of the present invention in a locked position in a well landing nipple.
Figure 1B:
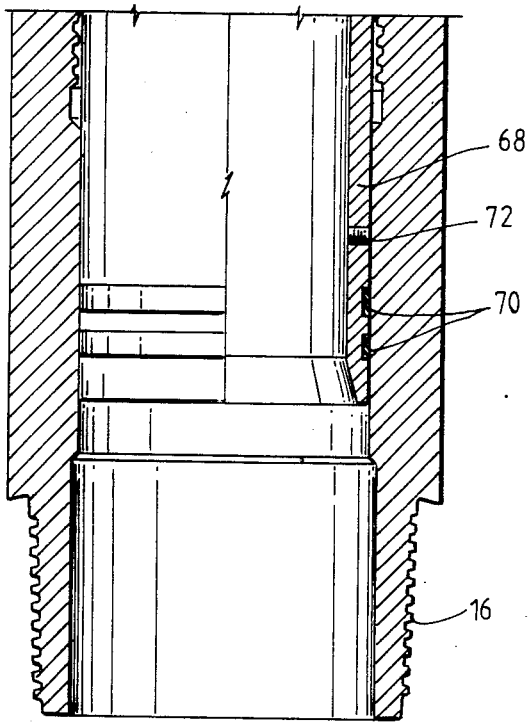
Figure 2:
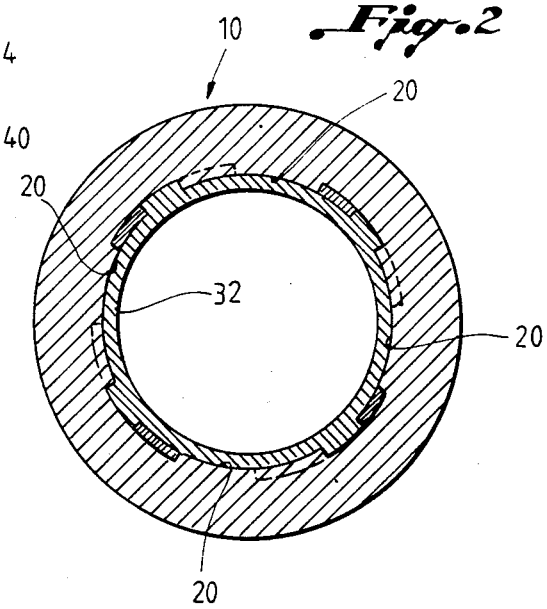
FIG. 2 is a cross-sectional view taken along the line 2—2 of FIG. 1A.
Figure 3:
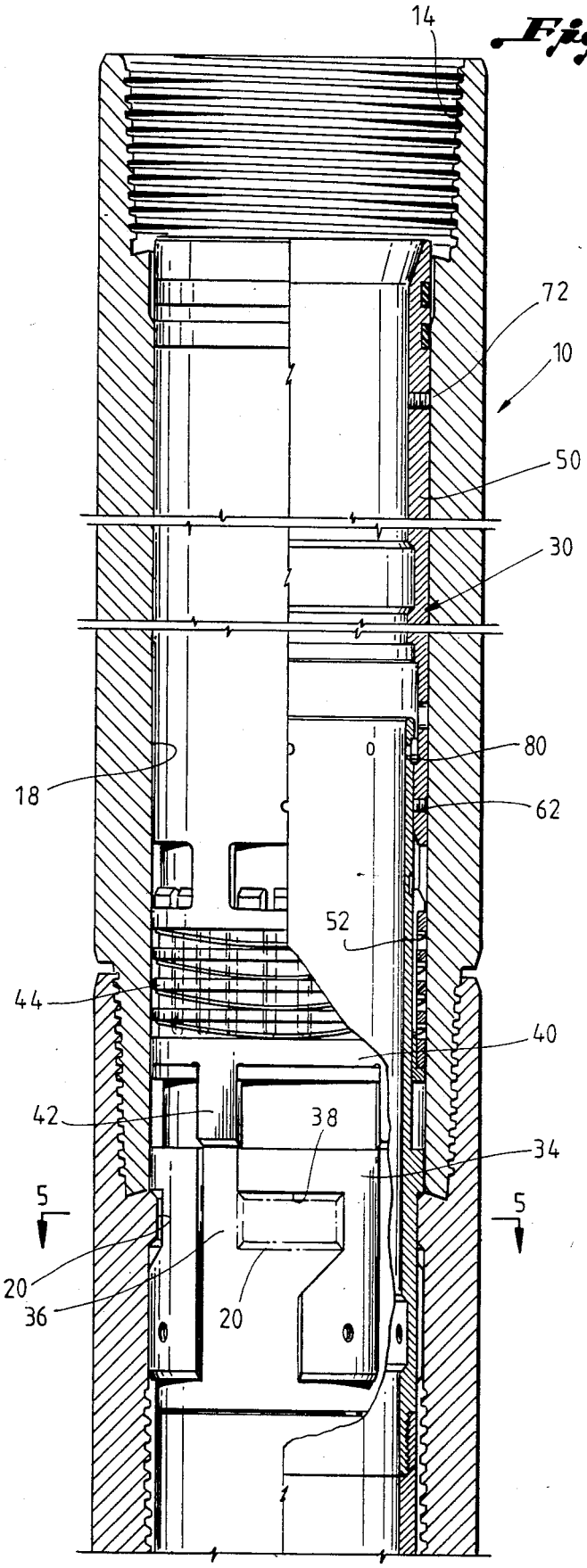
FIG. 3 is a fragmentary elevational view, in cross section, of part of the sleeve protector and landing nipple wherein the latching mechanism is unlocked.
Figure 4:
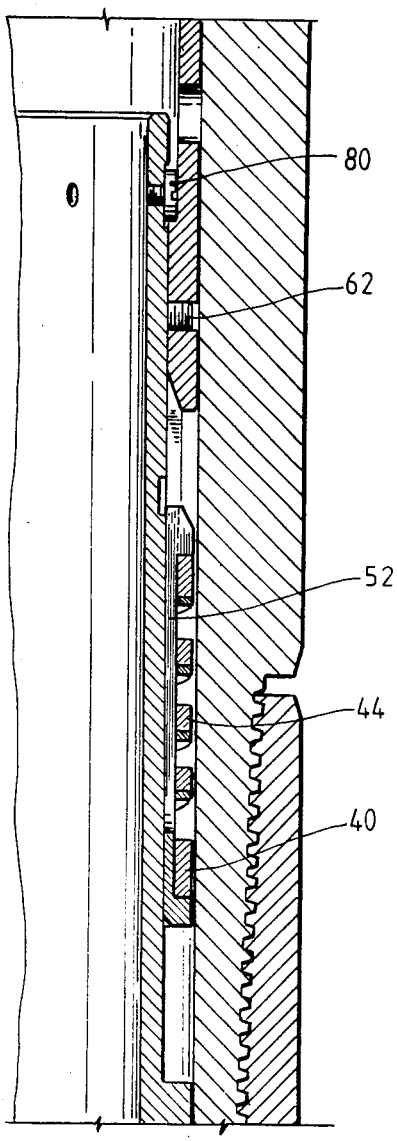
FIG. 4 is a fragmentary enlarged elevational view of a portion of the protector sleeve and landing nipple.
Figure 5:
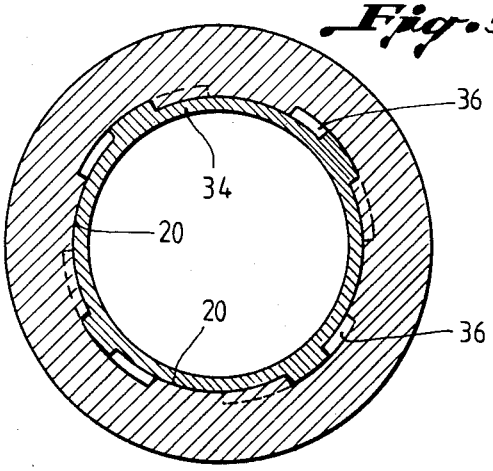
FIG. 5 is a cross-sectional view taken along the line 5—5 of FIG. 3.
Figure 6:
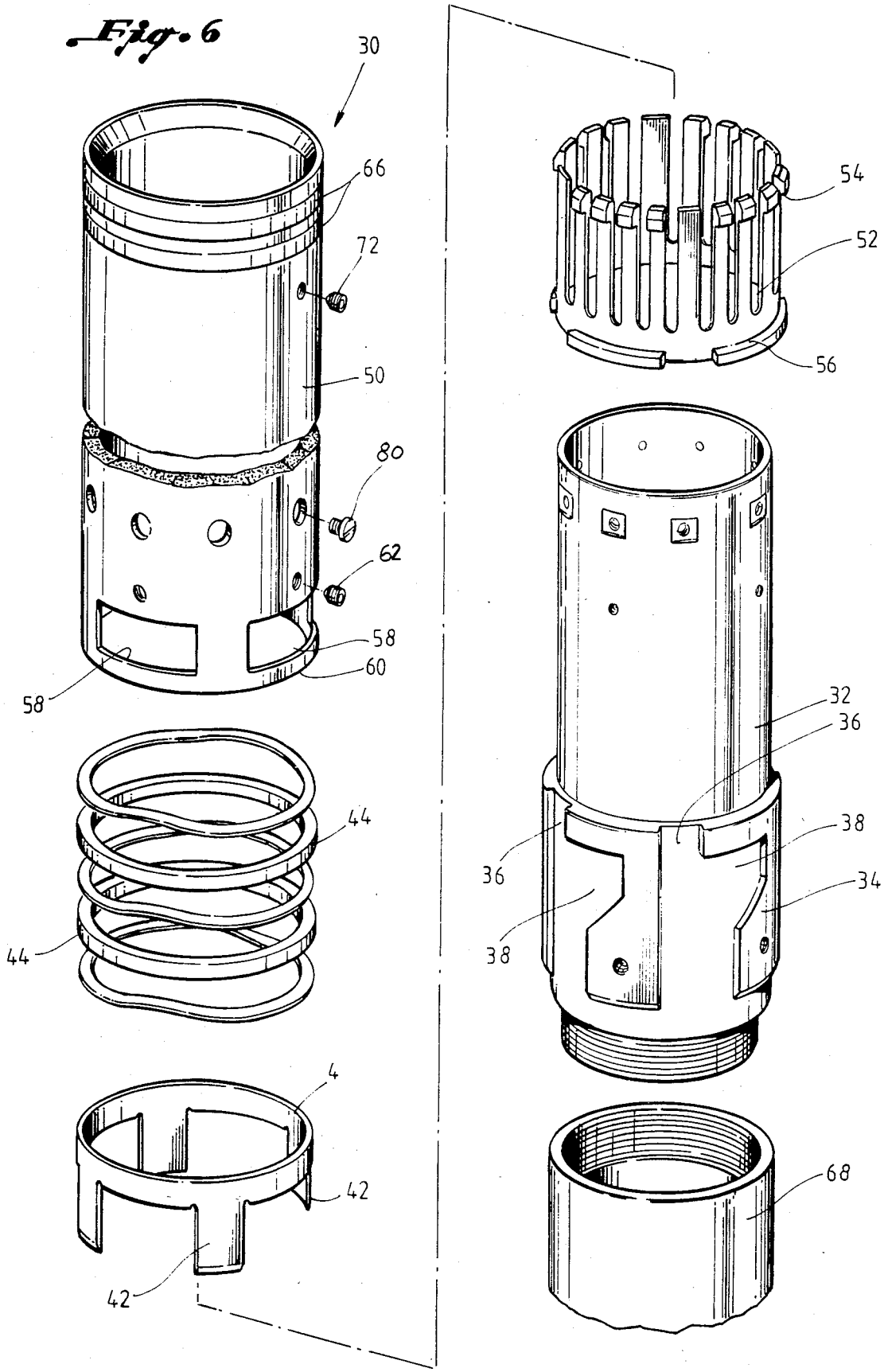
FIG. 6 is an exploded perspective view of the protector sleeve of the present invention.

Referring now to the drawings, in particular to FIGS. 1A, 1B and 2, the reference numeral 10 generally indicates a landing nipple having a tubular body 12 with connecting means at each end such as threads 14 at the top and 16 at the bottom for connection in a suitable well conduit such as a well casing. The landing nipple 10 is adapted to receive and support various types of well tools therein such as packers, safety valves, or other types of tools. For this purpose, the landing nipple 10 may include a polished bore 18 to provide a smooth surface for coacting with a seal on the well tool. In addition, the landing nipple 10 includes a no go, which in conventional landing nipples is a circular shoulder. In the present nipple 10, the no go is preferably a plurality of arcuate segments or lugs 20 here shown for convenience as four which are circumferentially positioned about the interior of the body 12. Each segment has an upwardly facing shoulder 22. As will be more fully described hereinafter, this segmented no go structure allows a protector sleeve locking mechanism to land, slide through, rotate and lock on to the no go segments 20 and be secured therefrom and hold the sleeve mechanically restrained against both vertical and rotational forces. In addition, the landing nipple 10 may include other profiles such as, for example, an internal thread 24 for coacting with a well tool. However, when the landing nipple 10 is threaded into a well conduit such as a well casing and various types of operational equipment is moved upwardly and downwardly through the conduit, the interior profiles of the landing nipple 10 such as the polished bore 18, the no go lugs 20 and/or the threads 24 may be damaged.

Another feature of the present invention is the provision of a protector sleeve for providing temporary and removable protection for the interior of the landing nipple 10 until the landing nipple 10 is needed for receiving a particular tool.

The reference numeral 30 generally refers to the nipple protector sleeve of the present invention and includes a body 32 which is a generally tubular body which includes supporting means for engaging the no go lugs 20 for supporting the body 32 from the interior of the landing nipple 10. Preferably, the supporting means includes an annular ridge 34 with a slot 36 extending upwardly through the ridge 34 for each of the lugs 20. The slots 36 are of a size to allow the body 32 to move downwardly so that the lugs 20 may enter the bottom of the slots 36. A recess 38 is offset from and in communication with the slots 36 and is positioned between the top and bottom of the ridge 34 and is sized to receive a no go lug 20. Therefore, the body 32 may land on the lugs 20 and if necessary may be rotated so that the lugs will mate into a slot 36 thereafter the body 32 is moved downwardly, rotated to the right to bring the lugs 20 into the recesses 38.

Releasable latching means is provided on the body for releasably latching the body 32 to the lugs 20. A sliding latch 40 is provided with downwardly directed fingers 42 each of which fit into and slide in the top of one of the slots 36. As best seen in FIG. 1A, a finger 42 is extended into the slot 36 and is in a locking position for locking the lug 20 in the recess 38. In this position, the body 32 and the sleeve 30 is mechanically restrained against both vertical and rotational forces acting on the sleeve 30.

Spring means such as wave washers 44 acts against the latching means 40 for yieldably urging the downwardly directed fingers 42 into the slots 36.

A sleeve section 50 is provided which is telescopically engaging the exterior of the body 32 and engages the latch means 40 for retracting the latch means and releasing the body 32 from the no go lugs 20. Thus, a connector collet 52 has a plurality of fingers with a shoulder 54 at one end and a shoulder 56 at a second end. The latching means 40 is carried by the connector collet above the shoulder 56 with the fingers 42 extending downwardly between the shoulders 56 and into the slots 36. The collet shoulders 54 are inserted into openings 58 in the sleeve section 50 and the wave springs 44 are positioned about the exterior of the connector collet 52 and between the lower end 60 of the sleeve section 50 and the top of the latching means 40. Therefore, with the sleeve section 50 locked to the body section 32 by a shear pin 62 the springs 44 are compressed between the end of the sleeve section 50 and the top of the latching means 40 to yieldably urge the fingers 42 downwardly into the slots 36. The sleeve 50 includes a notch 64 for receiving a retrieving tool for removing the sleeve 30. The sleeve section 50 also includes one or more seals 66 and the body may include a lower sleeve 68 which may be threaded thereto or made integrally therewith. In either event the lower sleeve 68 may also include seals 70. In addition, one or more grease injection ports 72 may be provided to inject the grease between the seals 66 and 70 and between the interior of the landing nipple 10 and the exterior of the sleeve 30 for sealing off the entire nipple profile from damaging well fluids.

A retaining pin 80 is provided such as in the body 32 for movement in a groove 82 in the sleeve section 50 for holding the body 32 to the sleeve 50 upon release.

In operation, when running the sleeve 30, as best seen in Figures lA and lB and 2, the sleeve 30 is moved into the nipple 10 with a service tool (not shown) and the ridge 34 on the body 32 may contact the top of the no go lugs 20 and require rotation of the sleeve 30 for alignment of the no go lugs 20 with the slots 36. The sleeve 30 is then rotated to bring the lugs 20 into registry with the slots 36, and is lowered, until the top of the recess 38 engages the top shoulders 22 of the no go lugs 20. It is to be noted that as the sleeve 30 is lowered, the lugs 20 will engage the bottom of the fingers 42 and force the latching mechanism upwardly against the springs 44. Further righthand rotation of the sleeve 30 will seat the no go lugs 20 into the recesses 38 thereby allowing the springs 44 to again move the latching means 40 downwardly causing the fingers 42 to move in the locked position thus securely latching the sleeve 42 to the no go lugs 20.

To retrieve the sleeve 30, a tool engages the notch 64 in the sleeve section 50 to shear the pins 62 thereby allowing the upper sleeve section 50 to telescope upwardly relative to the body 32. Upward movement of the section 50 pulls the collet connector 52 upwardly which in turn pulls the latching means 40 upwardly carrying the downwardly directed fingers 42 upwardly from the slots 32. Thereafter, the sleeve 30 may be rotated and/or cammed off of the no go lugs 20 and slide free of the landing nipple 10.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A nipple protector sleeve for a well conduit comprising, a body including supporting means for engaging no go lugs on the interior of a nipple in a well conduit for supporting the body from the well nipple, releasable latching means on the body for releasably latching the body to the no go lugs for preventing longitudinal and rotative movement of the body relative to the nipple, a sleeve section telescopically engaging the body and engaging said latching means for releasing said latching means and releasing said body when the section is moved relative to the body, said supporting means including, an annular ridge about the exterior of the body, a slot extending upwardly through the ridge whereby a no go lug may enter the bottom of the slot, a recess offset from and in communication with the slot between the top and bottom of the ridge for receiving a no go lug, the top of the slot receiving a portion of the latching means for movement in the top of the slot for locking and releasing a no go lug in the recess, and spring means engaging the latching means and yieldably urging the latching means into the slot.

2. A temporary and removable protector sleeve for use in a landing nipple in a well conduit in which the nipple includes a no go shoulder having a plurality of arcuate segments circumferentially positioned about the interior of the nipple comprising, a body movable through said well conduit and including supporting means for engaging said no go shoulder and supporting the body from the nipple, said supporting means including an annular ridge about the exterior of the body, a slot extending upwardly through the ridge whereby a no go segment may enter the bottom of the slot, a recess offset from and in communication with the slot between the top and bottom of the ridge for receiving a no go segment releasable latching means on the body for releasably latching the body to the no go segments, said latching means longitudinally movable in the slot for locking and releasing a no go segment in the recess, spring means engaging the latching means and yieldably urging the latching means into the slot, and a sleeve section telescopically engaging the body, engaging said spring means into engagement with the latching means, and engaging said latching means for retracting said latching means for retracting said latching means and releasing the body from the no go shoulder when the section is moved relative to the body.

* * * * *

UNITED STATES PATENT OFFICE

CERTIFICATE OF CORRECTION

PATENT NO. : 4,577,685

DATED : March 25, 1986

INVENTOR(S) : William D. Eatwell

It is certified that error appears in the above-identified patent and that said Letters Patent are hereby corrected as shown below:

Column 6, line 20, after the second occurrence of "means" delete -- for retracting said latching means --

Signed and Sealed this

Fourth Day of November, 1986

[SEAL]

*Attest:*

DONALD J. QUIGG

*Attesting Officer*

*Commissioner of Patents and Trademarks*